US007874960B2

(12) United States Patent
Akhmetov

(10) Patent No.: US 7,874,960 B2
(45) Date of Patent: Jan. 25, 2011

(54) BACK TWISTER

(75) Inventor: Zinnoor Akhmetov, 41 Armadale Close, London (GB) N17 9PJ

(73) Assignee: Zinnoor Akhmetov, London (GB)

( * ) Notice: Subject to any disclaimer, the term of this patent is extended or adjusted under 35 U.S.C. 154(b) by 208 days.

(21) Appl. No.: 12/155,492

(22) Filed: Jun. 5, 2008

(65) Prior Publication Data

US 2009/0005223 A1 Jan. 1, 2009

(30) Foreign Application Priority Data

Jun. 28, 2007 (GB) ..... 0712657.6

(51) Int. Cl.
*A63B 22/00* (2006.01)
*A63B 22/04* (2006.01)

(52) U.S. Cl. ..... 482/52; 582/51; 582/57

(58) Field of Classification Search ..... 482/52, 482/92, 908, 57–65, 51
See application file for complete search history.

(56) References Cited

U.S. PATENT DOCUMENTS 3,213,852 A * 10/1965 Lawson ..... 601/36
4,688,791 A * 8/1987 Long ..... 482/62
4,705,269 A * 11/1987 DeBoer et al. ..... 482/62
5,342,262 A * 8/1994 Hansen ..... 482/62
5,397,286 A * 3/1995 Chang ..... 482/62
6,837,829 B2 * 1/2005 Eschenbach ..... 482/52
7,402,126 B2 * 7/2008 Chang ..... 482/52

FOREIGN PATENT DOCUMENTS

GB 2349099 10/2000
GB 2371997 8/2002

* cited by examiner

*Primary Examiner*—Steve R Crow

(57) ABSTRACT

A Back Twister comprises:

a horizontal supporting platform 1 with attached bearing structure 6, an elliptical stepper with two footholds 3 attached to the horizontal supporting platform 1 a hand rotary member with two hand grips 7 attached to the bearing structure 6, a kinematic transmission 8 connecting the elliptical stepper and hand rotary member such that they are rotatable in synchronisation with a 1:1 gear ratio and the user having steady position may perform an elliptical motion with feet and circular motion with hands while keeping his/her torso suspended freely above the bearing structure whereby the only support for the users body are the footholds and hand grips, which provides good exercising for muscles and joints of the spinal column, The distance between the elliptical stepper and hand rotary member is adjustable, to suit different sized users.

1 Claim, 2 Drawing Sheets

BACK TWISTER

CROSS-REFERENCE TO RELATED APPLICATIONS

UK Patent GB 2349099 B discloses a training device which comprises a support frame, a guide structure, foot pedal means and hand pedal means mounted on the guide structure, a kinematic transmission connecting foot and hand pedal cranks, the user may perform a cyclical exercise based on the pedals keeping his/her spine in a horizontal position.

However practical tests show its essential shortcoming: it is very difficult for the user to keep balance based on the pedals freely turning around own axles, this involves foot and hand muscles rather than spinal muscles in training process.

UK Patent GB 2371997 B discloses a training device comprising a bench, weight bars with foot and hand pedals secured on crank-con-rod mechanisms and rotating in an elliptical orbit.

It has the same essential shortcoming—it is difficult to keep balance on rotational pedals, also said device has very complicated construction and it is problematical for the user to adjust desirable initial distance between the crank mechanisms and desirable angle of the weight bar to the horizontal.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY REFERENCE OF MATERIAL SUBMITTED ON A COMPACT DISC

Not Applicable

BACKGROUND OF INVENTION

The Back Twister relates generally to an exercise devices and more particularly, but not exclusively designed for training cardiovascular system, for exercising and strengthening the muscles of the spinal column and vertebrae joints, for the spine recreation.

SUMMARY OF THE INVENTION

The principal purpose of this invention is the creation of a simple Back Twister which keeps all benefits of said above training devices and which is free of said above shortcomings, I.e. gives the user a steady base and comfortable position and provides significant exercising for the muscles and joints of the spinal column.

According to the present invention there is provided the Back Twister comprising:

a supporting platform;

an elliptical strider including a foot rotary member mounted to the rear of the supporting platform and rotatable about a substantially horizontal axis, a shuttle arm pivotally connected at one end to each side of the foot rotary member at a position offset from the horizontal axis, with the other ends of the shuttle arms being configured to move along a substantially horizontal linear path, and a foot support attached to each shuttle arm so as not to move relative thereto, such that on rotation of the foot rotary member the foot supports are constrained to follow an elliptical path;

a bearing structure pivotally attached to the supporting platform and being adjustable to fix relative to the supporting platform at a desired angle, a hand rotary member rotatable about a substantially horizontal axis including two hand grips mounted on each side thereof at a position offset from the horizontal axis, the hand rotary member being positioned on the free end of the bearing structure, the distance between the elliptical strider and hand rotary member is adjustable;

a kinematic transmission connecting the elliptical strider and hand rotary member such that they are rotatable in synchronisation;

wherein a user having a steady position on the foot support and hand grips may simultaneously perform an elliptical motion with the feet and circular motion with the hands keeping his/her torso suspended above the exerciser;

means of adjustable training load resistance;

safety means for secure exercising.

BRIEF DESCRIPTION OF THE SEVERAL VIEWS OF THE DRAWINGS

The present invention will now be described by way of examples only and not in any limited sense with reference to the accompany drawings in which.

DETAILED DESCRIPTION OF THE INVENTION

Figure 1:
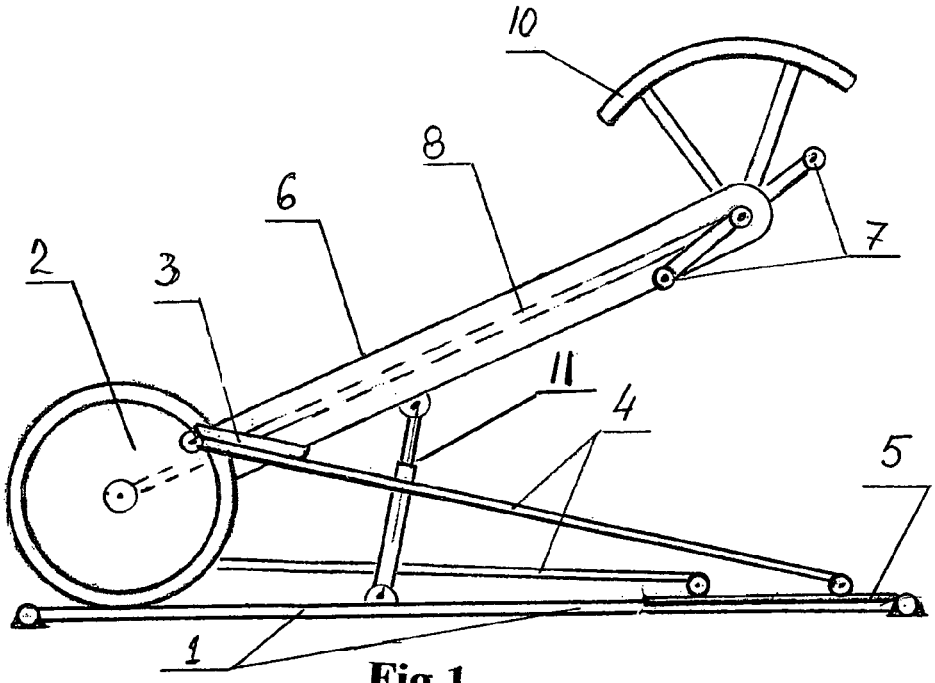
FIG. 1 side view.
Figure 2:
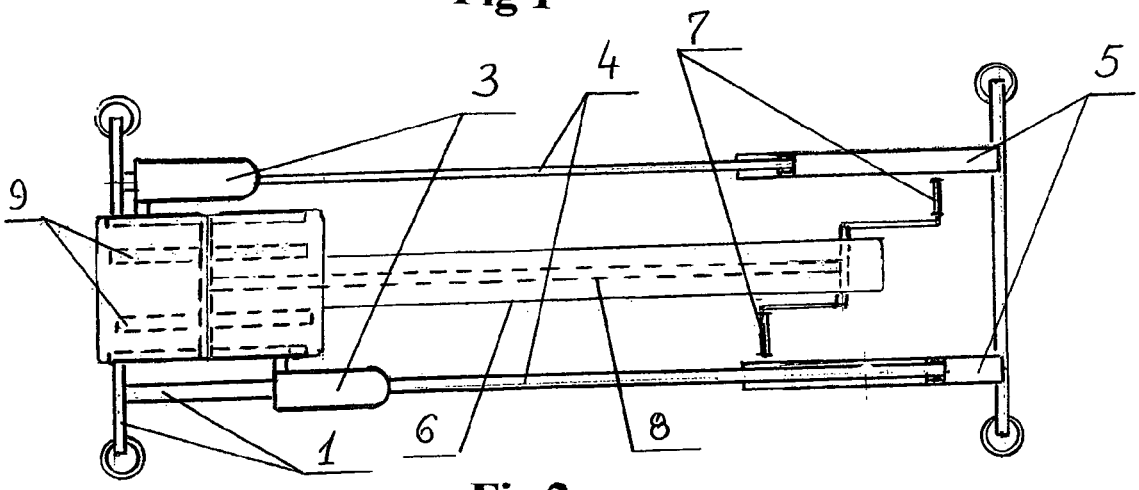
FIG. 2 view from above of the Back Twister with the bearing structure attached to the rear end of the supporting platform.

Referring to the FIGS. 1 and 2,

The Back Twister comprises:

a horizontal supporting platform 1;

an elliptical strider mounted on the supporting platform, the elliptical strider consists of a foot rotary member 2 , wherein said foot rotary member is a wheel, two footholds 3 being attached on shuttle arms 4, and two guide tracks 5 mounted on the supporting platform 1;

two footholds 3 being attached on said shuttle arms 4 provide a steady support and steady balance for the user, so the main training load is going to the muscles of the spinal column;

rear end of the shuttle arms are fixed eccentrically to the foot rotary members 2 with forward ends based on and movable along said guide tracks 5;

a bearing structure 6 pivotally attached to the rear end of the supporting platform 1 at a specified angle with capability of tilting in vertical plane up and down and fixing at the selected position with an adjustment mechanism 11;

a hand rotary member attached to the upper end of the bearing structure 6 having left and right hand grips 7, wherein said hand rotary member is a crank;

the capability of tilting said bearing structure 6 in vertical plane up and down allows redistributing user's weight between feet and hands. Tilting up the user reduces load on hands and increases load on feet, and vice versa;

a kinematic transmission 8 connecting the elliptical strider and hand rotary member such that they are rotatable in synchronization with a 1:1 gear ratio and allowing to switch to forward or reverse transmission of rotation between the elliptical strider and hand rotary member;

said synchronisation provides cyclical twisting and bending of the spinal column, thus gives good exercising for the muscles and joints of the spine;

said switching to forward or reverse transmission of rotation between the elliptical strider and hand rotary member widens the scope of the training motions for exercising and strengthening the musculoskeletal system;

the distance between the elliptical strider and hand rotary member is adjustable such that the user having a comfortable steady position and steady balance may perform an elliptical motion with feet and circular motion with hands while keeping his/her torso suspended freely above the bearing structure 6 whereby the only support for the users body are the footholds 3 and hand grips 7;

means of adjustable training load resistance 9;

chest support 10 for secure exercising.

Figure 3:
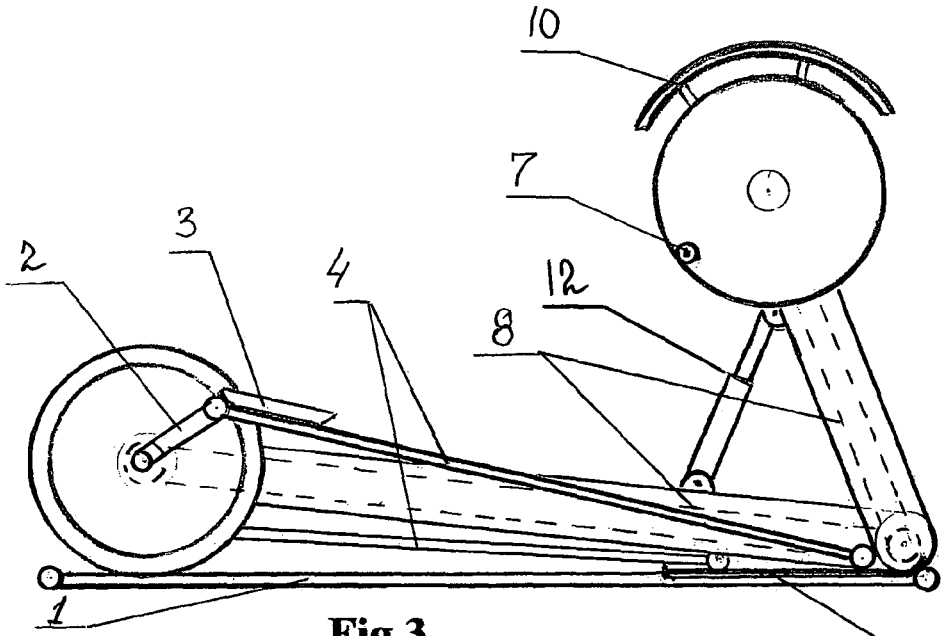
FIG. 3 side view.
Figure 4:
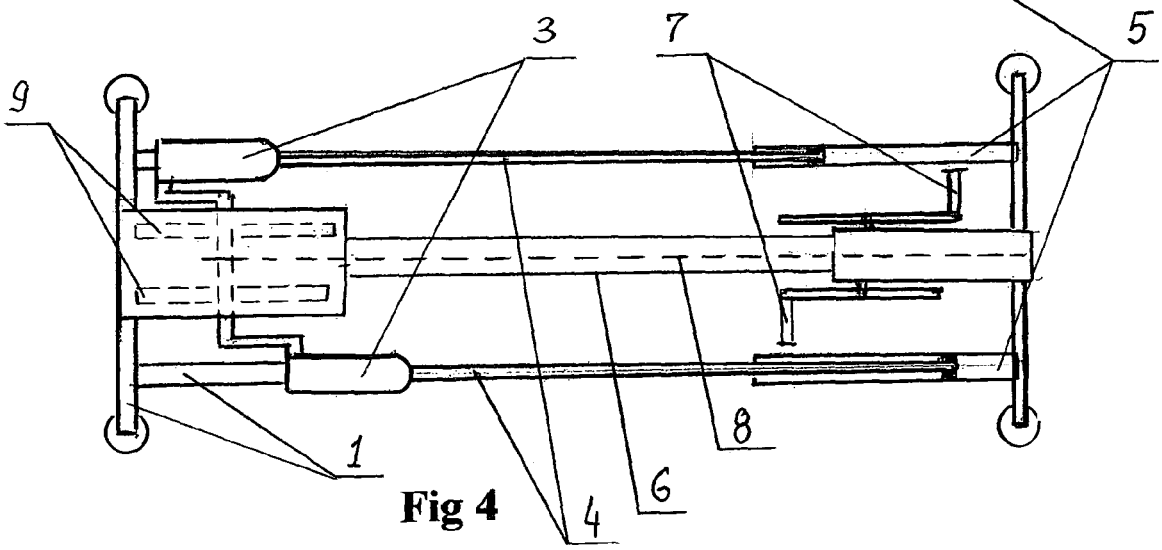
FIG. 4 view from above of the Back Twister with the bearing structure attached to the fore end of the supporting platform.

Referring to the FIGS. 3 and 4,

In an alternate embodiment the Back Twister comprises:

a horizontal supporting platform 1;

an elliptical strider secured to the supporting platform 1, and consisting of a foot rotary member 2, two footholds 3 being attached on shuttle arms 4, and two guide tracks 5, mounted on the supporting platform 1, wherein said foot rotary member is a crank;

a bearing structure 6 pivotally attached to the fore end of the supporting platform 1 with capability of tilting in vertical plane and fixing at the selected position so the distance between the elliptical strider and hand rotary member is adjustable with an adjustment mechanism 12;

hand rotary member having left and right hand grips 7 attached to the upper end of the bearing structure 6, wherein said hand rotary member is a wheel;

a kinematic transmission 8 connecting the elliptical strider and hand rotary member such that they are rotatable in synchronisation with a 1:1 gear ratio;

so the user having a comfortable steady position and steady balance may perform an elliptical motion with feet and circular motion with hands while keeping his/her torso suspended freely above the footholds and hand grips with the spine in a substantially free horizontal position whereby the only support for the users body are the foothold and hand grips;

means of adjustable training load resistance 9;

chest support 10 for secure exercising.

The described above Back Twister embodiments are to be considered in all aspects only as illustrative, but not restrictive. It should be clear that further embodiments may be made without departing from the scope of the present invention.

What is claimed is:

1. A Spine Twister comprising:

a supporting platform;

an elliptical strider including a foot rotary member mounted to the rear of the supporting platform and rotatable about a substantially horizontal axis, a pair of shuttle arms each pivotally connected at one end to each side of the foot rotary member at a position offset from the horizontal axis, with the other ends of the shuttle arms being configured to move horizontally, and a foot support attached on each shuttle arm so as not to move relative thereto, such that on rotation of the foot rotary member the foot supports are constrained to follow an elliptical path;

an adjustable length telescopic bearing structure pivotally attached to the horizontal axis of the elliptical strider with capability of tilting up and down in vertical plane and fixing at a desired angle to the supporting platform;

a bearing structure length adjustment mechanism;

a bearing structure angle adjustment mechanism;

a hand rotary member rotatable about a substantially horizontal axis including two hand grips mounted on each side thereof at a position offset from the horizontal axis, the hand rotary member being positioned on the free end of the bearing structure;

the distance between the elliptical strider and hand rotary member is adjustable;

a telescopic kinematic transmission with reversible gear box connecting the elliptical strider and hand rotary member such that the elliptical strider and hand rotary member are rotatable in synchronisation.

* * * * *